US008810117B2

(12) United States Patent
Fuchs et al.

(10) Patent No.: US 8,810,117 B2
(45) Date of Patent: Aug. 19, 2014

(54) SPARK PLUG HAVING A HOLE FOR ADJUSTMENT

(75) Inventors: Jochen Fuchs, Wattens (AT); Markus Kraus, Wiesing (AT)

(73) Assignee: GE Jenbacher GmbH & Co OHG, Jenbach (AT)

( * ) Notice: Subject to any disclaimer, the term of this patent is extended or adjusted under 35 U.S.C. 154(b) by 165 days.

(21) Appl. No.: 13/530,540

(22) Filed: Jun. 22, 2012

(65) Prior Publication Data

US 2012/0256531 A1 Oct. 11, 2012

(30) Foreign Application Priority Data

Dec. 23, 2009 (AT) ..... A 2026/2009

(51) Int. Cl.
*H01J 17/49* (2012.01)
*H01T 13/54* (2006.01)
*H01T 21/06* (2006.01)

(52) U.S. Cl.
CPC ..... *H01T 13/54* (2013.01); *H01T 21/06* (2013.01)
USPC ..... 313/141; 313/125

(58) Field of Classification Search
CPC ..... H01T 13/20; H01T 13/54; H01T 13/32; H01T 13/39; H01T 21/02
USPC ..... 313/118–141
See application file for complete search history.

(56) References Cited

U.S. PATENT DOCUMENTS 5,022,881 A 6/1991 Nagy
2005/0062386 A1 * 3/2005 Francesconi et al. ..... 313/143

FOREIGN PATENT DOCUMENTS

| | | |
|---|---|---|
| CN | 2796196 | 7/2006 |
| DE | 198 49 317 | 4/1999 |
| DE | 10 2008 000 163 | 8/2008 |
| EP | 1 517 416 | 3/2005 |
| JP | 55-101719 | 8/1980 |

OTHER PUBLICATIONS

International Search Report issued Mar. 2, 2011 in International (PCT) Application No. PCT/AT2010/000465.
Austrian Patent Office Search Report completed Jun. 24, 2010 in Austrian Patent Application No. A 2026/2009.

* cited by examiner

*Primary Examiner* — Anne Hines
(74) *Attorney, Agent, or Firm* — Wenderoth, Lind & Ponack, L.L.P.

(57) ABSTRACT

A spark plug includes a center electrode and a ground electrode. The center electrode is arranged relative to the ground electrode in such a way that the spark gap extends between the ground electrode and the center electrode. The spark gap is surrounded by a wall, wherein the wall has a recess or hole, which is designed in such a way that a feeler gauge can be inserted between the center electrode and the ground electrode.

12 Claims, 6 Drawing Sheets

SPARK PLUG HAVING A HOLE FOR ADJUSTMENT

This application is a Continuation of International Application No. PCT/AT2010/000465, filed Dec. 3, 2010, the entire disclosure of which is incorporated herein by reference.

BACKGROUND OF THE INVENTION

The invention concerns a spark plug comprising a center electrode and a ground electrode, in which the center electrode is arranged relative to the ground electrode so that the spark gap extends between the ground electrode and the center electrode, and the spark gap is surrounded by a wall. The invention further concerns a method of adjusting the spacing of the center electrode relative to the ground electrode of such a spark plug.

Spark plugs pass ignition current into the combustion chamber of an internal combustion engine and there ignite the fuel-air mixture by an ignition spark which flashes over between the electrodes (in the so-called spark gap). High temperatures occur in gas engines involving high power levels and large combustion chambers. In gas engines, an increasing trend is to provide a pre-chamber. The pre-chamber is markedly smaller in comparison with the actual combustion chamber and is separated from the combustion chamber by a wall, and relatively small transfer openings are provided to permit an exchange of fluid between the combustion chamber and the pre-chamber. Actual ignition with the spark plug takes place in the pre-chamber, in which case a comparatively rich fuel-air mixture is ignited there with the spark plug. The ignition flares which are produced in that case pass by way of the transfer openings into the actual combustion chamber and there ignite a comparatively weak fuel-air mixture.

A wall can protect the ground electrode and the center electrode from the high temperatures, and the wall is a good heat conductor. In addition, the electrodes can be extended closer to the insulating body of the spark plug to ensure a faster flow of heat into the spark plug casing. It will be noted, however, that this means that the electrodes are more difficult to access from the exterior. In the state of the art it was therefore necessary, after a certain operating time, to increase the ignition voltage in order to compensate for the spacing between the center electrode and the ground electrode, which becomes larger due to electroerosion. An alternative variant provides that the spark gap is not arranged parallel to the longitudinal axis of the spark plug but perpendicularly thereto in order to achieve access to the spark gap at least from the end of the spark plug. The disadvantage of that procedure however is that, in the case of such spark plugs, a plurality of ground electrodes are required as otherwise the ignition spark extends asymmetrically and the spark gap which is parallel to the longitudinal axis of the spark plug is undesirable.

SUMMARY OF THE INVENTION

Therefore the object of the present invention, in a spark plug of the kind set forth in the opening part of this specification, is to improve the possibility of adjusting the spacing between the center electrode and the ground electrode.

That object is attained in that the wall has a recess or other opening (through-hole) which is designed so that a feeler gauge can be inserted between the center electrode and the ground electrode.

The basic idea is therefore that the spark gap is left to be, for example, along, or parallel to the longitudinal axis of the spark plug and is to be made accessible from the side of the spark plug. In that respect, the fact that the wall surrounding the ground electrode and the center electrode is weakened by the recess or opening is intentionally tolerated. Preferably the spark gap then extends along or parallel to the longitudinal axis of the spark plug. The spark gap is that gap between the ground electrode and the center electrode, in which the spark jumps across. In that respect the feature that the wall surrounds the spark gap is to be interpreted in such a way that the spark gap is either completely surrounded by the wall in the radial direction, or it is surrounded by the body or housing of the spark plug where there is no wall.

The weakening of the wall is less significant if a fastening portion is provided for fastening the spark plug in a combustion chamber housing of an internal combustion engine. The recess or opening is completely covered by the combustion chamber housing in the condition of installation of the spark plug in the combustion chamber housing.

In the simplest case, the fastening portion can include a male thread and the wall at least region-wise carries the male thread.

In a preferred variant, the recess or opening can be arranged in the region of the male thread.

An advantageous configuration of the invention provides that the ground electrode is connected to the wall by way of a leg. It is advantageously provided in that respect that the leg extends substantially perpendicularly to the longitudinal axis of the spark plug.

To permit accessibility to the spark gap particularly well and to make the lever relationships for subsequent adjustment optimum, the recess or opening can be arranged in the wall at the opposite side of the fastening location of the leg to the wall.

The wall, leg and ground electrode can be permanently connected together, for example welded or made in one piece, or can otherwise be permanently connected together.

In the region of the recess or opening, the wall can have a cross-section which is substantially in the shape of a circular ring, wherein the recess or opening extends over a region of between 3 and 10%, preferably between 5 and 7%, along the outside periphery of the circle. In that way, the wall is only minimally weakened. Possibly not just one but a plurality of openings can be provided. The shape of the at least one opening is in the simplest case matched to the shape of a feeler gauge. It can for example have a circular, square, rectangular or polygonal configuration shape.

The longitudinal extent of the recess or opening along the spark gap can be between one and two times the spacing between the center electrode and the ground electrode.

The above-mentioned advantageous configuration with pre-chamber ignition is frequently achieved by the pre-chamber being introduced into the combustion chamber as a separate component. In the present case, however, it would be possible for the pre-chamber to be formed directly at the spark plug. Therefore, at the end there can be a preferably dome-shaped cover which in the installed condition separates the ground electrode and the center electrode from the combustion chamber of the internal combustion engine, and transfer openings are in the cover. Such a configuration would also have the advantage that no structural modification measures would be required on the internal combustion engine to change over from a "normal" combustion chamber ignition to pre-chamber ignition.

In a further aspect, the invention concerns a method of adjusting the spacing between a center electrode and a ground electrode in a spark plug of the specified kind. The method is distinguished in that a feeler gauge having a thickness corresponding to the desired spacing of the ground electrode to the center electrode is inserted by way of the recess or opening and the ground electrode is pressed relative to the center electrode until the spacing of the center electrode relative to the ground electrode corresponds to the thickness of the feeler gauge.

BRIEF DESCRIPTION OF THE DRAWINGS

Further advantages and details of the invention are described by means of the accompanying Figures and the specific description.

In the Figures.

DETAILED DESCRIPTION OF THE INVENTION

Figure 1A:
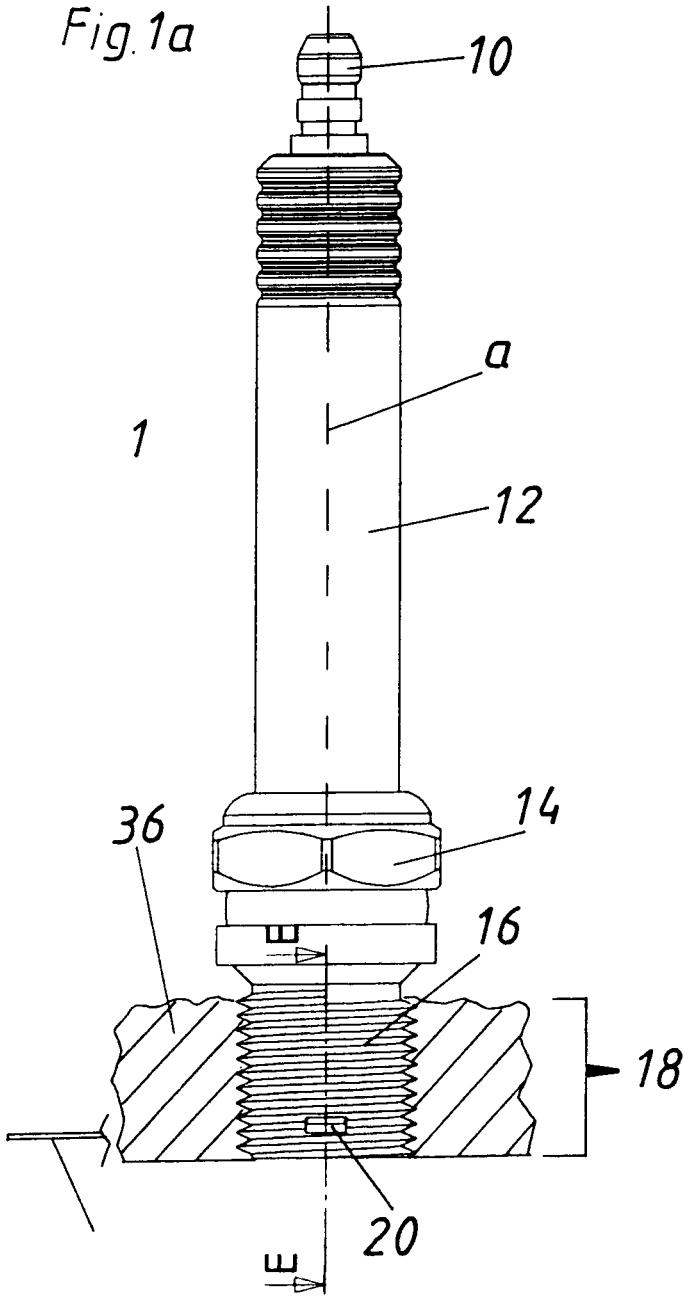
FIGS. 1*a* through 1*d* show four views of a first variant of a spark plug.
Figure 1B:
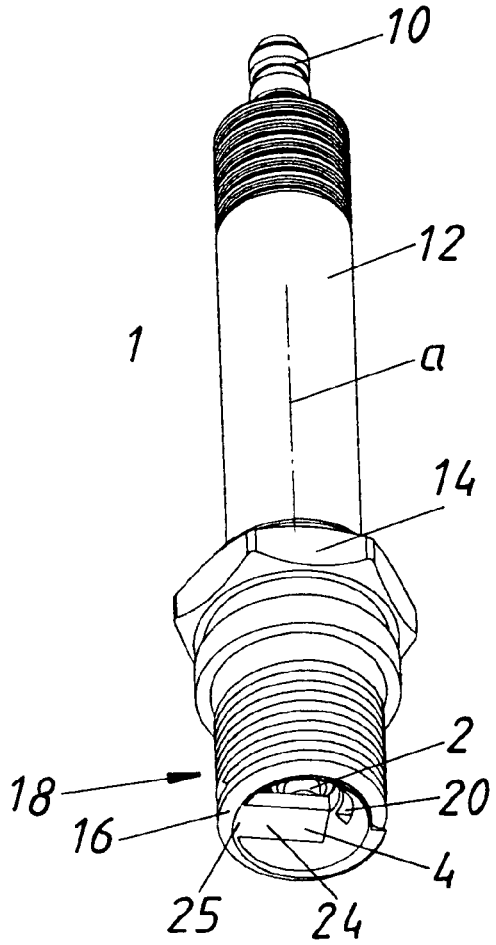
Figure 1C:
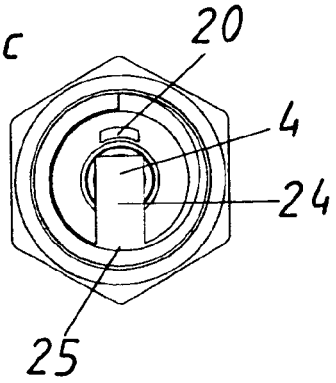
Figure 1D:
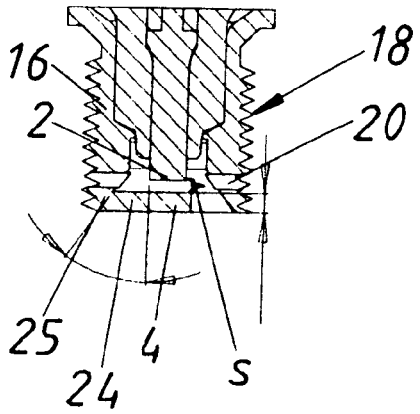

FIG. 1*a* shows a side view of a spark plug 1 according to a first variant of the invention. FIG. 1*b* shows an inclined view of the spark plug 1, FIG. 1*c* shows a view onto the end of the spark plug 1, and FIG. 1*d* shows a cross-section along plane E-E of the view in FIG. 1*a*. The spark plug 1 is described with reference to the four views. The spark plug 1 includes an insulating body 12 generally made from ceramic. Disposed at the top side is a connecting portion 10 which is electrically conducting and which is connected to an ignition coil or the like. The connecting portion 10 delivers the voltage to the center electrode 2 which extends in the interior of the ceramic body to the end where the center electrode 2 projects from the insulating body 12. The spark plug 1 further has a screw-in portion 14, generally in the form of a hexagon for screwing the spark plug 1 into the combustion chamber housing (diagrammatically shown at 36) of an internal combustion engine (not shown). There is also a thread 18 with which the spark plug 1 can be permanently connected to the combustion chamber housing 36. The thread 18 is arranged on the wall 16 which surrounds the ground electrode 4 and the center electrode 2 in such a way that the spark gap s is surrounded by that wall 16. A leg 24 extends from the wall 16 to the center of the spark plug 1, where the actual ground electrode 4 is formed as a counterpart electrode to the center electrode 2. It can be seen that the spark gap s between the ground electrode 4 and the center electrode 2 is formed in such a way that it extends along the longitudinal axis a of the spark plug 1.

Now, according to the invention, an opening 20 in the form of a through-hole is provided through which a feeler gauge can be inserted. Arranged on both sides of the wall 16 is a respective opening (hole) 20 which also is so arranged that the feeler gauge can be inserted from each side and can possibly be completely pushed through. By pressure being applied to the ground electrode 4, the spacing relative to the center electrode can be reduced by the leg 24 yielding somewhat until the thickness of the feeler gauge is reached and the desired electrode spacing s is set. As can be seen from the described embodiment, the wall 16 has a somewhat circular configuration in the region of the opening 20. The opening 20 is arranged on the side opposite to the fastening region 25 of the leg 24 (where leg 24 is fastened to wall 16). With respect to the periphery of the wall 16, the width b of the opening 20 constitutes about 6%. In regard to the thickness, that is to say the longitudinal extent k along the longitudinal axis a of the spark plug 1, the opening is slightly thicker than the electrode spacing s so that the feeler gauge can be easily inserted.

Figure 2A:
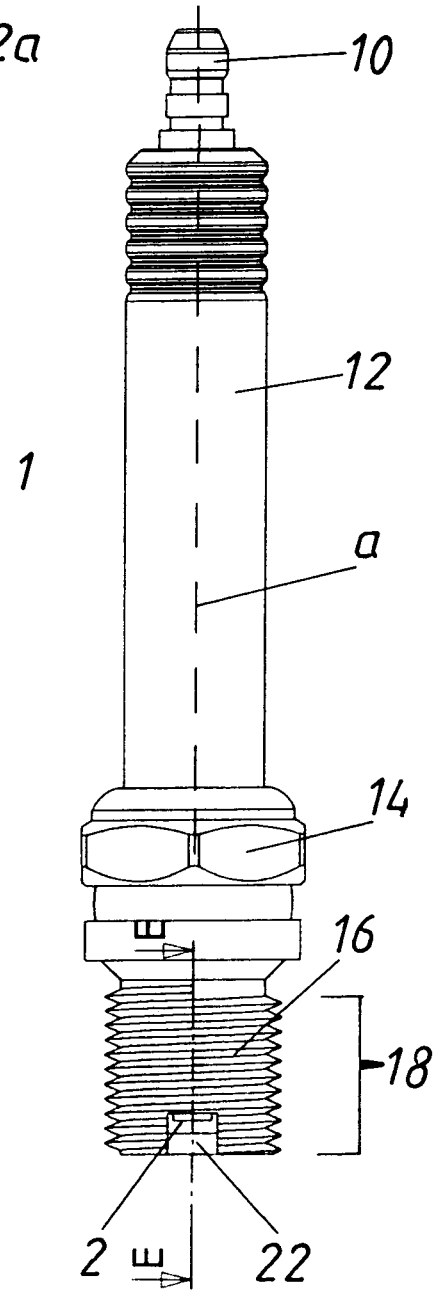
FIGS. 2*a* through 2*d* show four views of a second variant of a spark plug.
Figure 2B:
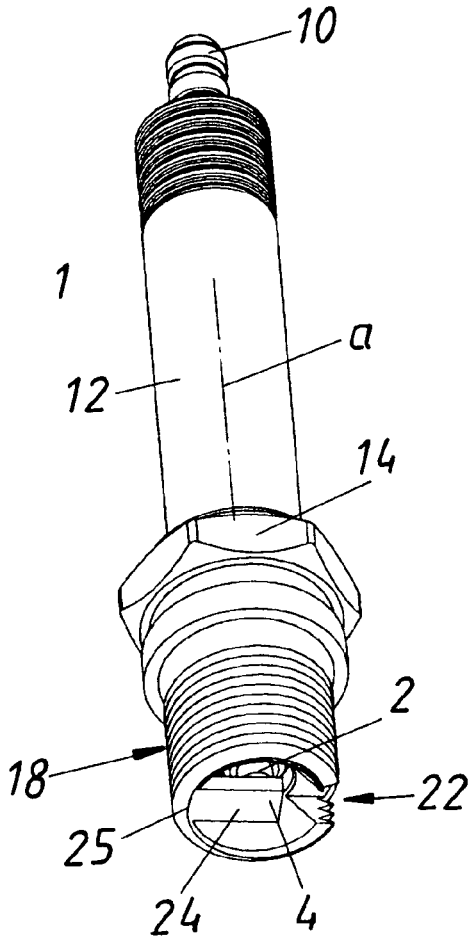
Figure 2C:
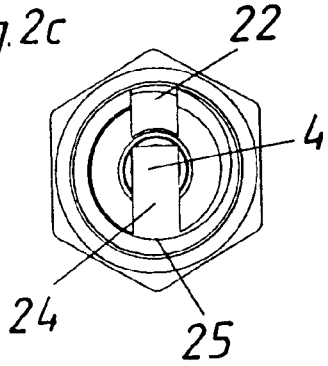
Figure 2D:
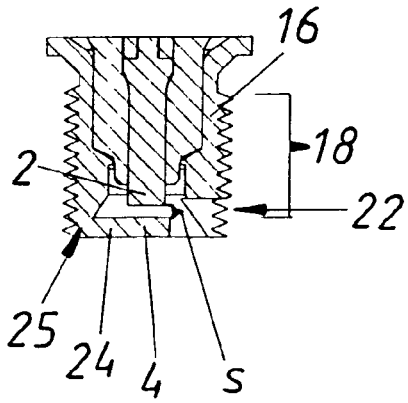

FIGS. 2*a* through 2*d* show a variant of the invention which substantially corresponds to that shown in FIGS. 1*a* through 1*d*. In that respect, therefore, attention can be directed to the specific description relating to FIGS. 1*a* through 1*d*. FIG. 2*a* shows a side view, FIG. 2*b* shows an inclined view, FIG. 2*c* shows a view onto the end and FIG. 2*d* shows a sectional view along plane E-E in FIG. 2*a*. Unlike the embodiment of FIGS. 1*a* through 1*d*, a recess 22 is now provided in place of a hole 20. The recess 22 also permits access for the feeler gauge. The width b of the recess 22 corresponds to the width b of the hole 20 in FIGS. 1*a* through 1*d*, while the longitudinal extent k is about three times the thickness of the electrode spacing s.

Figure 3A:
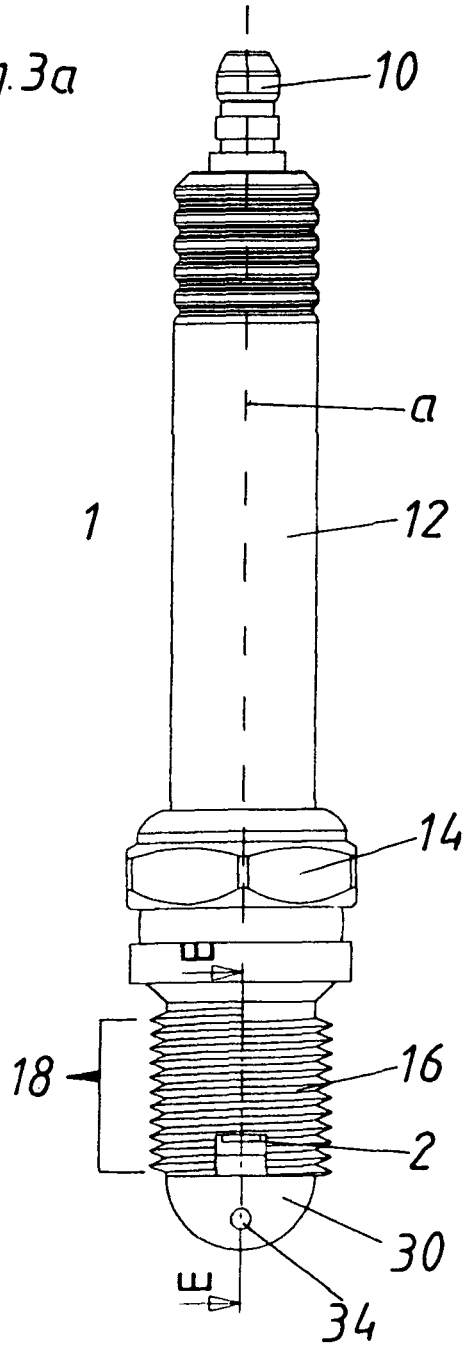
FIGS. 3*a* through 3*d* show four views of a third variant of a spark plug according to the invention.
Figure 3B:
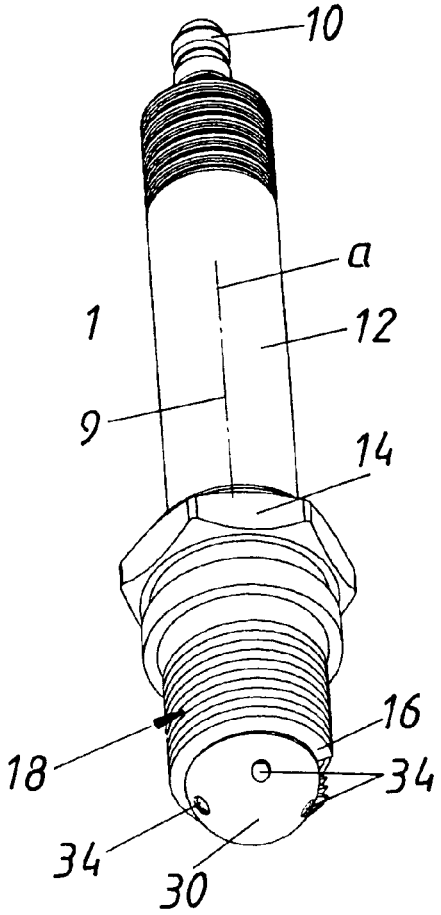
Figure 3C:
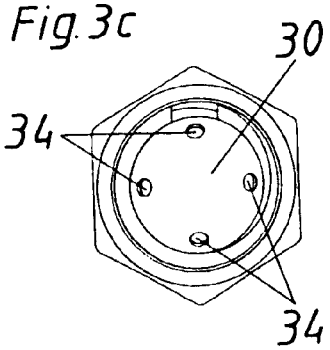
Figure 3D:
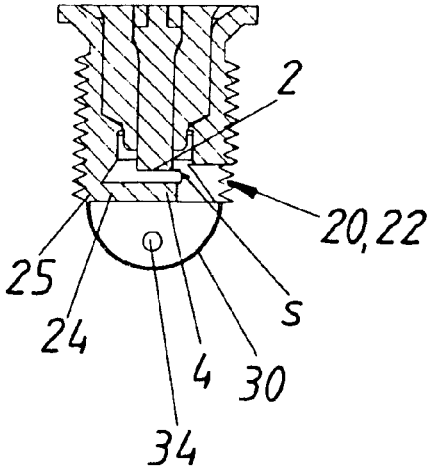

FIGS. 3*a* through 3*d* show a further variant of a spark plug 1 according to the invention, based on FIGS. 1*a* through 1*d* and 2*a* through 2*d*. Reference can also be made to the preceding specific description. In that respect, FIG. 3*a* shows a side view, FIG. 3*b* an inclined view, FIG. 3*c* a view onto the end and FIG. 3*d* a sectional view along plane E-E in FIG. 3*a*. Unlike the embodiment of FIGS. 2*a* through 2*d*, there is now additionally provided a cover 30 which delimits the spark plug 1 at the end, that is to say at the electrode end. The actual wall 16 in this case has an opening in the form of a recess 22 or a hole 20 which extends to the end of the thread 18. That is followed by a hemispherical dome forming the cover 30. Arranged on the cover 30 are flow transfer bores 34 which form the fluid exchange between the enclosed space in the spark plug 1 and the actual combustion chamber.

As can be seen from the Figures, the hole 20 or recess 22 is covered by the wall 36 of the combustion chamber housing in the installed condition as the spark plug is installed over the entire threaded portion 18. The combustion chamber housing is diagrammatically indicated by 36 in that respect in FIG. 1.

As can also be seen from all the Figures, the spark plugs have a wall 16 which conically converge in the interior towards the center of the spark plug 1. The space between the ground electrode 4 towards the insulating body 12 therefore has a frustoconical configuration. In that way, heat can be even better dissipated from the two electrodes 2, 4.

The invention claimed is:

1. A spark plug comprising:

a center electrode;

a ground electrode arranged relative to said center electrode such that a spark gap extends between said ground electrode and said center electrode; and a wall surrounding said spark gap and having a male thread forming a fastening portion for fastening said spark plug within a combustion chamber housing of an internal combustion engine, said wall having a through-hole arranged in said male thread such that said through-hole is completely surrounded on all sides by male threads, said through-hole being configured to allow a feeler gauge to be inserted through said through-hole and between said center electrode and said ground electrode.

2. The spark plug as set forth in claim 1, wherein said ground electrode is connected to said wall by a leg.

3. The spark plug as set forth in claim 2, wherein said leg extends substantially perpendicular to a longitudinal axis of said spark plug.

4. The spark plug as set forth in claim 3, wherein a location of said through-hole in said wall is located opposite a location at which said leg extends from said wall.

5. The spark plug as set forth in claim 2, wherein said wall, said leg, and said ground electrode are all integrally connected to have a one-piece construction.

6. The spark plug as set forth in claim 1, wherein in an area of said through-hole, said wall has a circular ring-shaped cross-section, said through-hole having an area extending over between 3% and 10% of an outside periphery of said circular ring-shaped cross-section.

7. The spark plug as set forth in claim 1, wherein a diameter of said through-hole along a longitudinal axis of said spark plug is between one and three times a length of said spark gap between said center electrode and said ground electrode.

8. The spark plug as set forth in claim 1, further comprising a dome-shaped cover at an end of said spark plug for separating said ground electrode and said center electrode from the combustion chamber of the internal combustion engine, said cover having transfer openings therethrough.

9. The spark plug as set forth in claim 1, wherein a longitudinal axis of said through-hole extending through said wall is perpendicular to a longitudinal axis of said spark plug.

10. The spark plug as set forth in claim 9, further comprising a leg extending inwardly from an inner surface of said wall, said leg having a base end connected to said wall and a distal end opposite said base end, said ground electrode being located at said distal end, and a location of said base end of said leg is diametrically opposite to a location of said through-hole through said wall.

11. The spark plug as set forth in claim 1, further comprising a leg extending inwardly from an inner surface of said wall, said leg having a base end connected to said wall and a distal end opposite said base end, said ground electrode being located at said distal end, and a location of said base end of said leg is diametrically opposite to a location of said through-hole through said wall.

12. A method of adjusting said spark gap between said center electrode and said ground electrode of said spark plug of claim 1, comprising:

inserting a feeler gauge through said through-hole in said wall, the feeler gauge having a thickness corresponding to a desired spark gap spacing; and pressing said ground electrode relative to said center electrode until said spark gap between said center electrode and said ground electrode corresponds to the thickness of the feeler gauge.

* * * * *